US008925120B2

(12) United States Patent
Khiroya

(10) Patent No.: US 8,925,120 B2
(45) Date of Patent: Jan. 6, 2015

(54) COMMODE/TOILET SEAT

(76) Inventor: Anish Vijay Khiroya, Rohnert Park, CA (US)

( * ) Notice: Subject to any disclaimer, the term of this patent is extended or adjusted under 35 U.S.C. 154(b) by 374 days.

(21) Appl. No.: 13/374,996

(22) Filed: Jan. 26, 2012

(65) Prior Publication Data

US 2013/0191980 A1 Aug. 1, 2013

(51) Int. Cl.
*A47K 13/00* (2006.01)

(52) U.S. Cl.
CPC ..... *A47K 13/00* (2013.01)
USPC ..... 4/237

(58) Field of Classification Search
USPC ..... 4/237, 239; D23/311; 137/237, 239
See application file for complete search history.

(56) References Cited

U.S. PATENT DOCUMENTS 4,964,179 A * 10/1990 Kimes ..... 4/239
5,412,815 A * 5/1995 Ellis ..... 4/239
D435,894 S * 1/2001 Brotherston ..... D23/311

* cited by examiner

*Primary Examiner* — Janie Christiansen
(74) *Attorney, Agent, or Firm* — Risto A. Rinne, Jr.

(57) ABSTRACT

An apparatus for providing easy access to a person's bottom while using a toilet or commode includes a thicker-style of seat placed directly over a toilet bowl of the toilet or on a portable commode. The seat includes a pair of side access openings that are located on a left and an opposite right side of the seat. The access openings allow for easy access to the person's bottom for hygienic cleaning after using the toilet or commode. The person reaches through either side access opening while holding toilet paper and wipes their bottom with a side-to-side or front-to-rear motion, thereby reducing a potential risk for contracting a urinary tract infection. An optional shield is disposed under the seat and directs bodily waste material into the toilet bowl or a container.

14 Claims, 2 Drawing Sheets

COMMODE/TOILET SEAT

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention, in general, relates to toilet seats and commode seats and, more particularly, to an improvement to a toilet or commode seat.

Toilet and commode seats are known. Toilet seats are standard parts of the toilet and provide a place for a person to sit while the toilet is used.

Commercial toilet seats located in public restrooms tend to be larger in size than residential toilet seats. Regardless of the type of toilet seat, commercial or residential, there is typically a small amount of room provided for a person to cleanse themselves after using the toilet.

The same is true for commode seats. Commode seats typically include the same design as standard toilet seats and therefore also do not provide adequate room for a person to cleanse themselves after using the commode.

If a person is disabled, it may be quite difficult to properly cleanse their bottom to a hygienic level. They may not possess enough dexterity in their hands to reach through a center opening provided in the toilet seat and be able to access their bottom. If the bottom is not thoroughly cleansed after a bowel movement, discomfort and infection may occur.

In addition, elderly persons may experience the same aforementioned difficulties using prior art toilet and commode seats. It also may be difficult for the elderly person to fully balance themselves while reaching through the center opening of the toilet seat to cleanse themselves.

In addition, it is advised that a wiping of one's bottom should be done using a rearward wiping motion. This is especially advised for women. If wiping is done with a back to front wiping motion, women are subject to a higher risk of acquiring a urinary tract infection.

Conventional toilet and commode seats do not permit rearward wiping due to their design. It is difficult to reach through the center opening and wipe using only a rearward motion. In some cases, people may resort to standing up above the toilet seat to wipe their bottom, however, this technique may be impossible for disabled or elderly persons. It is certainly awkward for all others.

Accordingly, there exists today a need for a commode/toilet seat that helps to ameliorate the above-mentioned problems and difficulties as well as ameliorate those additional problems and difficulties as may be recited in the "OBJECTS AND SUMMARY OF THE INVENTION" or discussed elsewhere in the specification or which may otherwise exist or occur and that are not specifically mentioned herein.

As various embodiments of the instant invention help provide a more elegant solution to the various problems and difficulties as mentioned herein, or which may otherwise exist or occur and are not specifically mentioned herein, and by a showing that a similar benefit is not available by mere reliance upon the teachings of relevant prior art, the instant invention attests to its novelty. Therefore, by helping to provide a more elegant solution to various needs, some of which may be long-standing in nature, the instant invention further attests that the elements thereof, in combination as claimed, cannot be obvious in light of the teachings of the prior art to a person of ordinary skill and creativity.

Clearly, such an apparatus would be useful and desirable.

2. Description of Prior Art

Commode and toilet seats are, in general, known. For example, the following patent documents describe various types of these devices, some of which may have some degree of relevance to the invention. Other patent documents listed below may not have any significant relevance to the invention. The inclusion of these patent documents is not an admission that their teachings anticipate any aspect of the invention. Rather, their inclusion is intended to present a broad and diversified understanding regarding the current state of the art appertaining to either the field of the invention or possibly to other related or even distal fields of invention.

U.S. Pat. No. 6,868,561 to Myers, that issued on Mar. 22, 2005;

U.S. Pat. No. 2,810,914 to Hamilton, that issued on Oct. 29, 1957;

U.S. Pat. No. 2,241,967 to Sperzel, et al., that issued on May 13, 1941; and

U.S. Pat. No. Re. 20,696 to Sperzel, et al., that issued on Apr. 12, 1938.

And including U.S. Design Patents:

U.S. Design Pat. No. Des. 408,901 to Machanic, that issued on Apr. 27, 1999;

U.S. Design Pat. No. Des. 287,534 to Broeils, that issued on Dec. 30, 1986; and

U.S. Design Pat. No. Des. 242,457 to Landsberger, that issued on Nov. 23, 1976.

While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a commode/toilet seat that may be used with a conventional toilet.

It is also an important object of the invention to provide a commode/toilet seat that may be retrofitted (i.e., secured) onto a conventional toilet to provide an alternate toilet seat.

Another object of the invention is to provide a commode/toilet seat that may be used on a commode or a stand-alone type of commode.

Still another object of the invention is to provide a commode/toilet seat that may be used with a conventional toilet or a commode after an original seat of the toilet or the commode has been placed in a raised position.

Still yet another object of the invention is to provide a commode/toilet seat that may be a temporary seat placed over a conventional type of toilet or a commode seat.

Yet another important object of the invention is to provide a commode/toilet seat that may be hingedly-attached to a conventional type of toilet or a commode.

Still yet another important object of the invention is to provide a commode/toilet seat that includes a first side access opening located on a left side of the commode/toilet seat and an opposite second side access opening located on a right side of the commode/toilet seat.

A first continuing object of the invention is to provide a commode/toilet seat that includes a first and a second side access opening that permits access to a bottom of a person sitting upon the commode/toilet seat.

A second continuing object of the invention is to provide a commode/toilet seat that includes an optional pair of sliding odor rails that are disposed on an exterior of the commode/toilet seat which may slide over a first side access opening and over a second side access opening to reduce odors should a quantity of bodily waste material be disposed within a toilet bowl or a container for an extended period of time.

A third continuing object of the invention is to provide a commode/toilet seat that allows a person to clean their bottom while sitting on the commode/toilet seat using a front-to-rear wiping motion direction with a quantity of toilet paper.

A fourth continuing object of the invention is to provide a commode/toilet seat that includes a partial shield that is attached to an underside of a front and a rear portion of the commode/toilet seat.

A fifth continuing object of the invention is to provide a commode/toilet seat that includes a partial shield that directs bodily waste material into a toilet bowl or a container that is disposed under the commode/toilet seat.

A sixth continuing object of the invention is to provide a commode/toilet seat that includes a partial shield that is disposed within a center opening of a conventional type of toilet seat or a commode seat that maintains the commode/toilet seat in place.

A seventh continuing object of the invention is to provide a commode/toilet seat that includes a thickness of approximately four inches.

An eighth continuing object of the invention to provide a commode/toilet seat that may include any desired thickness.

A ninth continuing object of the invention is to provide a commode/toilet seat that includes a thickness that places a person higher up for easier mounting and dismounting from a conventional type of toilet or a commode.

A tenth continuing object of the invention is to provide a commode/toilet seat that may be used on a residential or a commercial type of toilet.

An eleventh continuing object of the invention is to provide a commode/toilet seat that lessens a risk for contracting a urinary tract infection.

A twelfth continuing object of the invention is to provide a commode/toilet seat that is comfortable.

Briefly, a commode/toilet seat that is constructed in accordance with the principles of the present invention has a relatively thick seat for use with a commode or a conventional toilet. The commode may be either a stand-alone type of commode or one that is placed directly over a toilet bowl of the toilet. The toilet may be either a commercial or a residential toilet. The size of the commode/toilet seat may only be for one type of toilet or it may include a universal design to accommodate both residential and commercial sizes. An original toilet seat of the toilet is preferably removed or is raised prior to placement of the commode/toilet seat onto the toilet. The commode/toilet seat includes a raised height of approximately four inches, however any desired height may be included. A thin right portion and an opposite thin left portion of the commode/toilet seat extend across a top surface of the commode/toilet seat and connect with a wider front portion and a wider rear portion to form a generally circular structure for the commode/toilet seat. A center opening is preferably provided, which is placed directly over a front of the toilet bowl or a front of a container that is included with the stand-alone commode. If desired, a large front recess may be included on the front portion, which provides an extension to the center opening. The recess is commonly included on prior art types of commodes and possibly prior art toilet seats. The recess provides easy access to a front pubic area of a person and also provides access to the center opening of the commode/toilet seat. A first side access opening is included on a left side of the commode/toilet seat. A second side access opening is included on an opposite right side of the commode/toilet seat. The first and second side access openings allow the person to access their bottom for cleaning after using the commode or toilet. The first and second side access openings permit the person sitting on the commode/toilet seat to reach under the commode/toilet seat while holding a quantity of toilet paper and wipe their bottom using a side-to-side motion or a front-to-back motion. It is preferred that the first and second side access openings are utilized for cleansing of the bottom instead of reaching through the recess located on the front portion of the commode/toilet seat or through the center opening. The first and second side access openings provide easier access to the person's bottom for proper hygienic cleaning. The first and second side access openings are especially convenient for women, elderly or disabled persons to properly clean themselves after using the commode or toilet. By using the side-to-side or the front-to-back wiping motion, a potential risk for women to contract a urinary tract infection is decreased as bacteria is not brought forward to the vaginal area from the rear. Women are advised to wipe their bottoms using a rearward motion. This type of motion is not practical with prior art types of commode or toilet seats. An optional partial shield is included on an underside of the front and the rear portions of the commode/toilet seat. The partial shield is comprised of two separate panels that extend downward along the front and rear portions of the commode/toilet seat. The partial shield is used to direct bodily waste material into the toilet bowl or into the container of the stand-alone commode that is disposed under the commode/toilet seat. The partial shield additionally helps maintain the commode/toilet seat in position with respect to the commode or toilet that it is placed upon. An optional pair of sliding rails may be included that are disposed on an exterior of the commode/toilet seat. The sliding rails are mounted on a track that allows the rails to slide in a left or right horizontal direction over the first and second side access openings. The sliding rails provide a cover panel for covering the first and second side access openings to reduce an amount of odor that can be released should any bodily material be left in the toilet bowl or container of the commode for a long period of time. The commode/toilet seat may either be a moveable temporary seat or it may be retrofitted (i.e., secured) directly to the commode or toilet using bolts or any other preferred means. If desired, a pair of hinges may be included to hingedly-attach the commode/toilet seat to the conventional toilet. The hinges allow the commode/toilet seat to pivot upward or downward.

DETAILED DESCRIPTION OF THE INVENTION

Figure 1:
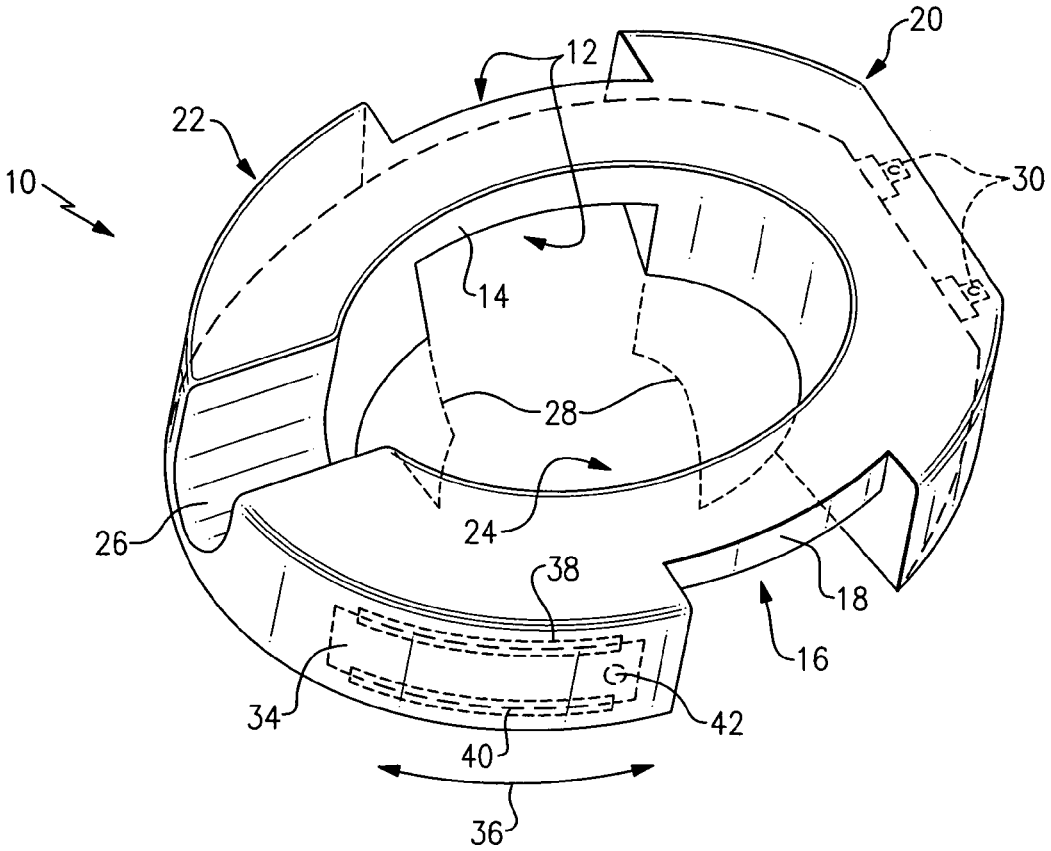
FIG. 1 is a view in perspective of a commode/toilet seat.

Referring on occasion to all of the FIGURE drawings and now, in particular to FIG. 1, is shown a commode/toilet seat, identified in general, by the reference numeral 10.

The reader will notice that reference is occasionally made throughout the DETAILED DESCRIPTION OF THE INVENTION suggesting that the reader refer to a particular drawing FIGURE. The suggestion is at times made when the introduction of a new element requires the reader to refer to a different drawing FIGURE than the one currently being viewed and also when the timely viewing of another drawing FIGURE is believed to significantly improve ease of reading or enhance understanding. To promote rapid understanding of the instant invention the reader is encouraged to periodically refer to and review each of the drawing FIGURES for possible cross-referencing of component parts and for other potentially useful information.

Certain examples are shown in the above-identified FIGURES and are described in greater detail below. In describing these examples, like or identical reference numerals may be used to identify common or similar elements.

The commode/toilet seat 10 is comprised of a thick seat that includes a raised height of approximately four inches, however any desired height may be included. The thickness of the commode/toilet seat 10 helps raise a person (not shown) higher than a prior art toilet seat of a conventional toilet. This is useful for disabled or elderly persons in which less bending down to sit upon a top surface of the commode/toilet seat 10 is required.

Figure 2:
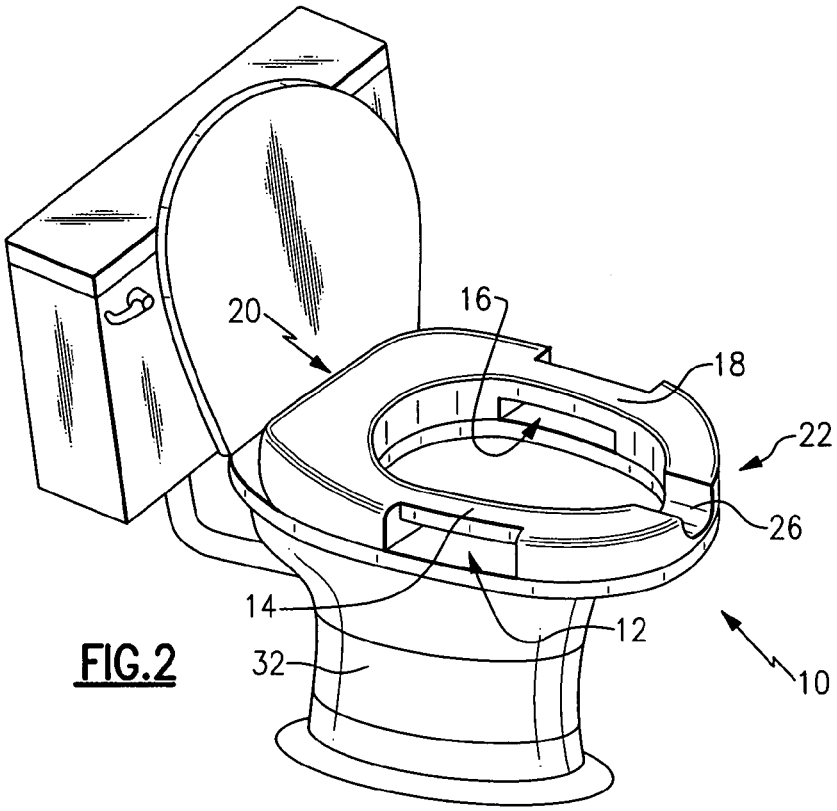
FIG. 2 is a view in perspective of the commode/toilet seat of FIG. 1 disposed on a standard toilet.

The commode/toilet seat 10 can be used with a conventional toilet 32 (see FIG. 2). Additionally, the commode/toilet seat 10 may also be used with a stand-alone type of commode 33 (see FIG. 3) or a type of commode that is placed directly over a toilet bowl of the toilet 32 (not shown). An original toilet seat of the toilet 32 is preferably raised or removed prior to placement of the commode/toilet seat 10 onto the toilet 32 or the commode 33.

The toilet 32 may be either a commercial toilet 32 or a residential toilet 32. Commercial types of the toilet 32 tend to be slightly larger in seat and bowl size than the residential type of toilet 32. The size of the commode/toilet seat 10 may be designed to include a size for use with only the residential toilet 32 or with only the commercial toilet 32 or it may include a universal design (i.e., size) to accommodate both types (commercial or residential) of the toilet 32. Similarly, it may be sized to fit any desired type of a portable commode.

The commode/toilet seat 10 includes a first side access opening, identified in general by the reference numeral 12. The first side access opening 12 is located below a thin left portion 14 of the commode/toilet seat 10.

A second side access opening, identified in general by the reference numeral 16, is located on an opposite right side below a thin right portion 18 of the commode/toilet seat 10.

The first and the second side access openings 12, 16 include a size that is sufficiently large enough for the person to extend a hand and a portion of an arm (not shown) through either of the side access openings 12, 16.

The left and right portions 14, 18 extend across the top surface of the commode/toilet seat 10, and connect with a rear portion, identified in general by reference numeral 20. The left and right portions 14, 18 further extend to connect with a front portion, identified in general by reference numeral 22. All portions 14, 18, 20 and 22 form a complete generally circular circumference for the commode/toilet seat 10. If desired, it is possible to modify the commode/toilet seat 10 so that the front portion 22 includes a gap (i.e., does not form a complete circle).

The left and right portions 14, 18 are slightly thinner in width than the rear and front portions 20, 22 to accommodate the first and second side access openings 12, 16. However, the top surface of the commode/toilet seat 10 is large enough to provide a comfortable sitting area for the person to sit upon while using the commode 33 or the toilet 32. The thinner width of the left and right portions 14, 18 is provided by removing some of the material of the left and right portions 14, 18 along an outer portion, thereof, over the first and second side access openings 12, 16.

The first and second side access openings 12, 16 provide access for the person to comfortably reach their bottom for cleaning after using the commode 33 or toilet 32. The first and second side access openings 12, 16 permit the person sitting on the commode/toilet seat 10 to reach under the either the left portion 14 or under the right portion 18 while holding a quantity of toilet paper (not shown). The narrower width of the left and right portions 14, 18 allow the hand and arm of the person sitting on the commode/toilet seat 10 to easily reach their bottom (i.e., anus) for cleaning.

The first and second side access openings 12, 16 are especially convenient for women, elderly or disabled persons to properly clean themselves after using the commode or toilet 32.

Conventional toilet seats included on either the commercial or residential type of toilet 32 or on the portable commode do not provide adequate clearance for a person to easily reach their bottom for cleaning. If the person is disabled with limited dexterity of their hands, accomplishing proper hygienic cleaning is difficult, if not impossible, to achieve. It is also very difficult for a person to clean their bottom using anything other than a back-to-front wiping motion using any prior art type of toilet or commode seat. This increases the risk of acquiring a urinary tract infection. Furthermore, it is impossible to access one's bottom for cleaning from the side using a prior art type of toilet or commode seat.

During use, the person performs the wiping motion by accessing their bottom through the first and second side access openings 12, 16, and not through a center opening 24, as is commonly done with prior art toilet or commode seats. This provides an important unexpected benefit as disabled persons with limited dexterity in their hands are easily able to reach their bottoms to provide hygienic cleaning.

By using the first and second side access openings 12, 16 the person is then able to wipe their bottom using a side-to-side motion or a front-to-back motion. It is preferred that the first and second side access openings 12, 16 are utilized for cleansing of the bottom as they provide direct access to the bottom for cleaning.

By using the side-to-side wiping motion while cleaning a rectal area, an unexpected benefit is provided. The side-to-side wiping motion or the front-to-back wiping motion helps to decrease a potential risk for women to contract a urinary tract infection by avoiding contact with a vaginal pubic area during wiping of the rectal area. Bacterium that may be present in the rectal area is not brought forth to the vaginal area from the rear.

Women are advised to wipe their bottoms using a rearward motion to avoid contacting their vaginal area while wiping their rectal area. This is not practical with prior art types of toilet or commode seats and it is all but impossible for the elderly of disabled to accomplish with prior art types of toilet or commode seats.

If access to the front pubic area is necessary, a large front recess 26 may be included on the front portion 22. The front recess 26 is commonly included on prior art types of commodes or prior art types of toilet seats. The front recess 26 provides easy access to the front pubic area of the person and also provides access to the center opening 24 area of the commode/toilet seat 10.

The center opening 24 of the commode/toilet seat 10 is placed directly over the toilet bowl or over a container 33*a* (see FIG. 3) included with the stand-alone commode 33.

If desired, a partial shield 28 (shown in dashed lines) is included on an underside of the rear and front portions 20, 22 of the commode/toilet seat 10. The partial shield 28 is comprised of two separate panels that extend downward from the front and rear portions 20, 22 of the commode/toilet seat 10. The partial shield 28 is used to better direct bodily waste material into the toilet bowl or the container 33*a* that is disposed under the commode/toilet seat 10.

The partial shield additionally helps maintain the commode/toilet seat 10 in position with respect to the commode or toilet 32 that it is placed upon.

Now referring to FIG. 2, is shown the commode/toilet seat 10 placed upon the toilet 32. The original toilet seat of the toilet 32 has been removed for clarity.

The commode/toilet seat 10 may either be a moveable temporary seat or it may be retrofitted (i.e., secured) directly to the commode or toilet using bolts or any preferred means (not shown). If desired, a pair of hinges 30 (dashed lines, FIG. 1) may be included to hingedly-attach the commode/toilet seat 10 to the conventional toilet 32. The hinges 30 allow the commode/toilet seat 10 to pivot upward or downward, however a range of pivotal motion may be limited due to the thickness of the commode/toilet seat 10.

If desired, an optional pair of sliding rails 34 (only one is shown, FIG. 1) may be included proximate the left side access opening 12 and the right side access opening 16 on an exterior of the commode/toilet seat 10.

The sliding rails 34 are able to move in either a left or right direction, as shown by arrow 36. The sliding rails 34 may be positioned over either the first or second side access opening 12, 16 to provide a means for covering the first and second side access openings 12, 16 in order to help reduce an amount of odor that is able to escape from the toilet 32 or the commode 33 should any bodily waste be left within the toilet bowl or commode 33 container 33*a* for an extended period of time (i.e., overnight).

The sliding rails 34, as shown, do not fully cover the first side access opening 12 or the second side access opening 16 when they are urged into a closed position. However, the sliding rails 34 do help limit an emission of offensive odors when disposed in the closed position. It is also to be understood that the sliding rails 34 can be modified, as desired, to more fully cover the first and second side access openings 12, 16.

The sliding rails 34 slide along an upper track 38 and a lower track 40. A thumb hole 42 or other preferred means to grasp the sliding rail 34 are provided on an exterior surface of the sliding rail 34. The person places a thumb (or other finger) into the thumb hole 42 and moves the sliding rail 34 along the upper and lower tracks 38, 40.

The sliding rails 34 are moved away from the first and the second side access openings 12, 16 to provide access to the person's bottom after the person has ceased using the toilet 32 or commode 33.

It is to be understood that the toilet 32, as shown in FIG. 2, can include any type of portable commode that is desired and that the commode/toilet seat 10 can similarly be used with any type of the portable commode.

Figure 3:
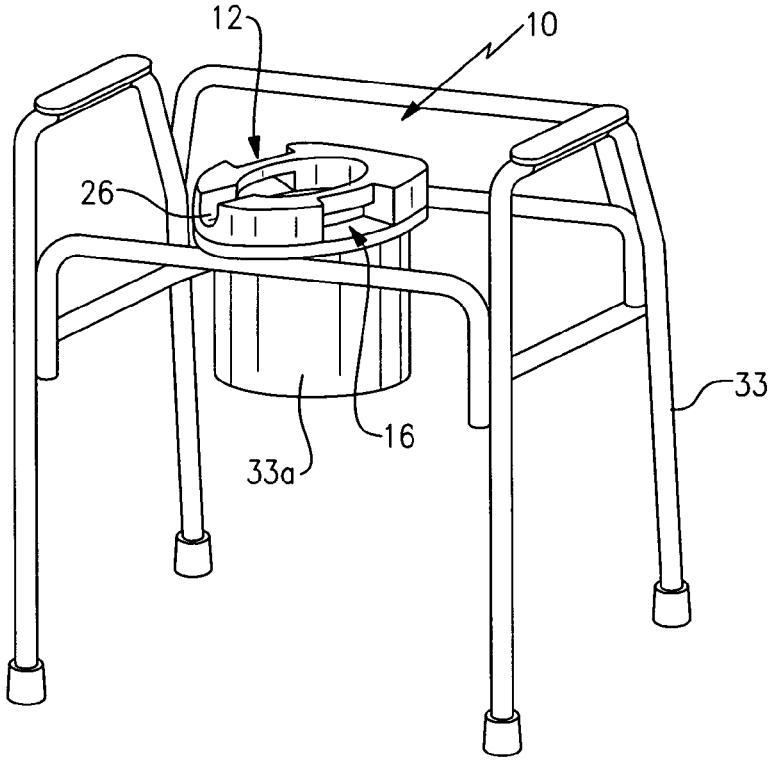
FIG. 3 is a view in perspective of the commode/toilet seat of FIG. 1 disposed on a stand-alone type of commode.

Referring now to FIG. 3, the stand-alone type of commode 33 is shown with the commode/toilet seat 10 disposed over the container 33*a* of the commode 33. The container 33*a* is removable for emptying. The stand-alone type of commode 33 allows convenient access for a person (elderly or disabled) to relieve themselves without having to use the toilet 32. In particular, the first and second side access openings 12, 16 allow easy access for elderly or disabled people to clean their bottoms using the side-to-side or slight front-to-back wiping motion. This greatly decreases the likelihood of contracting a urinary tract infection.

The commode/toilet seat 10 is used in the same aforementioned manner that has been previously described for use with the toilet 32.

The commode/toilet seat 10 may also be used on any type of the toilet 32 or commode 33 that is intended for use by children or infants (i.e., sized for children or infants).

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. An improvement to a seat for use with a toilet or a portable commode, wherein the improvement comprises a side opening that is provided on a left side of the seat or on a right side of the seat or on the left side of the seat and on the right side of the seat, and wherein the side opening includes a size that is sufficient to permit a hand and a portion of an arm of a person sitting on the seat to pass through the opening and for at least a portion of the hand of the person to contact an anus of the person without the person having to lift any of their buttocks above an upper plane of the seat, and wherein the side opening is disposed approximately halfway between a front of the seat and a rear of the seat, and wherein a plane of the side opening is generally perpendicular with respect to the upper plane of the seat, and wherein the side opening is not disposed at a front of the seat.

2. The seat of claim 1 wherein the seat includes a left portion that includes an upper surface that is on the same plane as an upper surface of a rear portion of the seat and on the same plane as an upper surface of a front portion of the seat, and wherein the left portion is disposed over the side opening that is provided on the left side of the seat.

3. The seat of claim 2 wherein the left portion is flush with an interior perimeter of a center opening of the seat.

4. The seat of claim 3 wherein the left portion includes a width that is less than a width of the rear portion of the seat that is adjacent to the left portion, and wherein the left portion includes a width that is less than a width of the front portion of the seat that is adjacent to the left portion.

5. The seat of claim 3 wherein the left portion includes a thickness that is less than a thickness of the rear portion of the seat that is adjacent to the left portion, and wherein the left portion includes a thickness that is less than a thickness of the front portion of the seat that is adjacent to the left portion.

6. The seat of claim 1 wherein the seat includes a right portion that includes an upper surface that is on the same plane as an upper surface of a rear portion of the seat and on the same plane as an upper surface of a front portion of the seat, and wherein the right portion is disposed over the side opening that is provided on a right side of the seat.

7. The seat of claim 6 wherein the right portion is flush with an interior perimeter of a center opening of the seat.

8. The seat of claim 7 wherein the right portion includes a width that is less than a width of the rear portion of the seat that is adjacent to the right portion, and wherein the right portion includes a width that is less than a width of the front portion of the seat that is adjacent to the right portion.

9. The seat of claim 7 wherein the right portion includes a thickness that is less than a thickness of the rear portion of the seat that is adjacent to the right portion, and wherein the right portion includes a thickness that is less than a thickness of the front portion of the seat that is adjacent to the right portion.

10. The seat of claim 1 including means for providing a covering disposed over at least a portion the left portion or over at least a portion of the right portion.

11. A commode/toilet seat for use with a toilet or a portable commode, comprising:

(a) a commode/toilet seat that includes a generally circular or oval shape, and wherein said commode/toilet seat includes a center opening and an inner perimeter around said center opening, and an outer perimeter; and (b) a side access opening that is disposed on a left side of said commode/toilet seat or on a right side of said commode/toilet seat or on both said left side and said right side of said commode/toilet seat, and wherein said side access opening includes a height that is less than a maximum thickness of said commode/toilet seat, and wherein said side access opening includes a length that is sufficient to permit a person that is sitting on said commode/toilet seat to insert their hand and a portion of their arm through said side access opening sufficient to reach their anus for cleaning without the person having to lift any of their buttocks above an upper plane of said commode/toilet seat; and wherein said side access opening is disposed approximately halfway between a front of said commode/toilet seat and a rear of said commode/toilet seat, and wherein a plane of said side access opening is generally perpendicular with respect to said upper plane of said commode/toilet seat, and wherein said side access opening is not disposed at a front of said commode/toilet seat.

12. The commode/toilet seat of claim 11 wherein said side access opening is disposed under a portion of said commode/toilet seat that extends from a front portion of said commode/toilet seat to a rear portion of said commode/toilet seat, and wherein said portion of said commode/toilet seat that is disposed over said side access opening includes a width that is less than a width of said front portion of said commode/toilet seat, and wherein said portion of said commode/toilet seat that is disposed over said side access opening includes a width that is less than a width of said rear portion of said commode/toilet seat.

13. The commode/toilet seat of claim 11 including means for providing a covering disposed over at least a portion of said side access opening.

14. The commode/toilet seat of claim of claim 13 wherein said means for providing a covering includes a sliding rail that is adapted to be urged from an open position that does not obstruct said side access opening into a closed position that provides a covering over at least a portion of said side access opening.

* * * * *